US005226271A

United States Patent [19]

Karhu

[11] Patent Number: 5,226,271

[45] Date of Patent: Jul. 13, 1993

[54] APPARATUS FOR REVERSE STRANDING AND A METHOD IN CONNECTION WITH STRANDING AND REVERSE STRANDING

[75] Inventor: Raimo Karhu, Helsinki, Finland

[73] Assignee: Nokia-Maillefer Holding, S.A., Switzerland

[21] Appl. No.: 718,382

[22] Filed: Jun. 20, 1991

[30] Foreign Application Priority Data

Jun. 29, 1990 [FI] Finland ..... 903309

[51] Int. Cl.[5] ..... H01B 13/02

[52] U.S. Cl. ..... 57/293; 57/9; 57/294; 57/351; 57/352

[58] Field of Search ..... 57/9, 13, 293-294, 57/350, 352; 385/100, 103

[56] References Cited

U.S. PATENT DOCUMENTS

| | | | |
|---|---|---|---|
| 3,847,190 | 11/1974 | Forester | 57/13 X |
| 3,910,022 | 10/1975 | Reed | 57/293 |
| 4,154,049 | 5/1979 | King et al. | 57/293 |
| 4,332,436 | 6/1982 | Adorni et al. | 57/350 X |
| 4,388,800 | 6/1983 | Trezeguet et al. | 57/13 X |
| 4,414,802 | 11/1983 | Garner et al. | 57/293 |
| 4,426,837 | 1/1984 | Meilenner et al. | 57/293 |
| 4,426,838 | 1/1984 | Garner et al. | 57/13 X |
| 4,426,839 | 1/1984 | Garner et al. | 57/13 X |
| 4,429,519 | 2/1984 | Garner et al. | 57/293 |
| 4,949,537 | 8/1990 | Rawlyk et al. | 57/13 X |
| 4,974,408 | 12/1990 | Karhu | 57/9 X |

FOREIGN PATENT DOCUMENTS

| | | | |
|---|---|---|---|
| 2-262212 | 10/1990 | Japan | 57/350 |

*Primary Examiner*—Daniel P. Stodola
*Assistant Examiner*—William Stryjewski
*Attorney, Agent, or Firm*—Finnegan, Henderson, Farabow, Garrett & Dunner

[57] ABSTRACT

A reverse stranding apparatus for the reverse stranding of conductors to produce cables or the like and to a method in connection with stranding and reverse stranding. The conductors are drawn from a distributor into a nozzle or equivalent through peripheral tubes circumferentially surrounding a central tube and being twistable about the central tube recurrently in opposite directions. To facilitate the passage of the conductor, a pressurized fluid is fed through the peripheral tubes upstream ends and into the peripheral tubes during the drawing of the conductors to produce oscillation, whereby the conductors passing through each peripheral tube remain substantially detached from the inner surfaces of the peripheral tubes.

9 Claims, 2 Drawing Sheets

APPARATUS FOR REVERSE STRANDING AND A METHOD IN CONNECTION WITH STRANDING AND REVERSE STRANDING

BACKGROUND OF THE INVENTION

The invention relates to an apparatus reverse stranding, for the manufacturing of conductors, such as filaments, conductor elements, bundles of conductors, optical fibres or equivalent, said apparatus comprising a stationary distributor means disposed at the upstream end for the conductors to be twisted, a twisting means rotatable in different directions and disposed at the downstream end for the conductors to be twisted, and peripheral tubes disposed between the distributor means and twisting means, being twistable recurrently about their longitudinal axes in opposite directions and peripherally surrounding a central tube, the central tube and peripheral tubes being pressed against each other at least during the step of twisting the conductors, and the conductors to be twisted being adapted to pass through at least the peripheral tubes. The invention further relates to a method in connection with reverse stranding, comprising drawing conductors, such as filaments, conductor elements, bundles of conductors, optical fibres and the like, from a distributor means into a nozzle or the like through peripheral tubes circumferentially surrounding a central tube and being twistable about the central tube recurrently in opposite directions, as well as a method in connection with the stranding of optical fibres, comprising feeding fibres from a distributor means into a nozzle or the like through peripheral tubes surrounding a central tube, transporting a core member provided with grooves through the central tube, and guiding the fibres by means of the peripheral tubes into the grooves in the core member.

Many different kinds of apparatus and methods as presented above are known in the cable industry. The apparatus and method disclosed in U.S. Pat. No. 4,974,408 may be mentioned as an example of the known solutions. The solution disclosed in U.S. Pat. No. 4,974,408 operates completely faultlessly in most circumstances. However, in some circumstances it has been found that the friction characteristics between the conductors and the inner surfaces of the peripheral tubes are not optimal. Furthermore, specifically optical cables have presented problems in the bending and heat expansion of the cables, which have resulted in an increase in the damping of the cable.

SUMMARY OF THE INVENTION

The object of the invention is to provide an apparatus and a method wherein the drawbacks of the previously known solutions can be eliminated. The apparatus of the invention is characterized in that means for feeding a pressurized fluid into the peripheral tubes have been provided at the upstream ends of the peripheral tubes to produce oscillation in the conductor passing through each peripheral tube, whereby the conductor remains substantially detached from the inner surface of the peripheral tube as it passes through the peripheral tube. The method of the invention for its part is characterized in that during the drawing of the conductors a pressurized fluid is fed through the upstream ends of the peripheral tubes and into the peripheral tubes to produce oscillation in the conductor passing through each peripheral tube. Then the conductor will remain substantially detached from the inner surface of the peripheral tube. On the other hand, the method in connection with the stranding of optical fibres is characterized in that during the run of the fibres a pressurized fluid is fed through the peripheral tube upstream ends and into the peripheral tubes to produce oscillation in the fibre passing through each peripheral tube, whereby the advancing speed of the fibre in the peripheral tube rises higher than the transport speed of the core member and a length of fibre greater than the length of the groove is fed into each groove of the core member.

An advantage of the invention lies above all in that the tensile stresses in the conductors, that is, fibres, filaments etc., remain low and uniform during the entire reversal interval. A further advantage is that one achieves longer reversal intervals than in the known art. In the stranding of optical fibres, an essential advantage is that it is possible to deposit more fibre in for instance the V-groove of the core member than is called for by the sz or helical form of the V-groove. In helical stranding, the peripheral tubes serve as guides and in sz stranding the tubes are twisted by positive guidance along with the V-groove. A further advantage of the invention is the simplicity thereof, on account of which taking into use and working the invention is advantageous.

BRIEF DESCRIPTION OF THE DRAWINGS

The following is a description of the invention by means of some advantageous embodiments presented in the accompanying drawing, wherein.

DETAILED DESCRIPTION OF THE INVENTION

Figure 1:
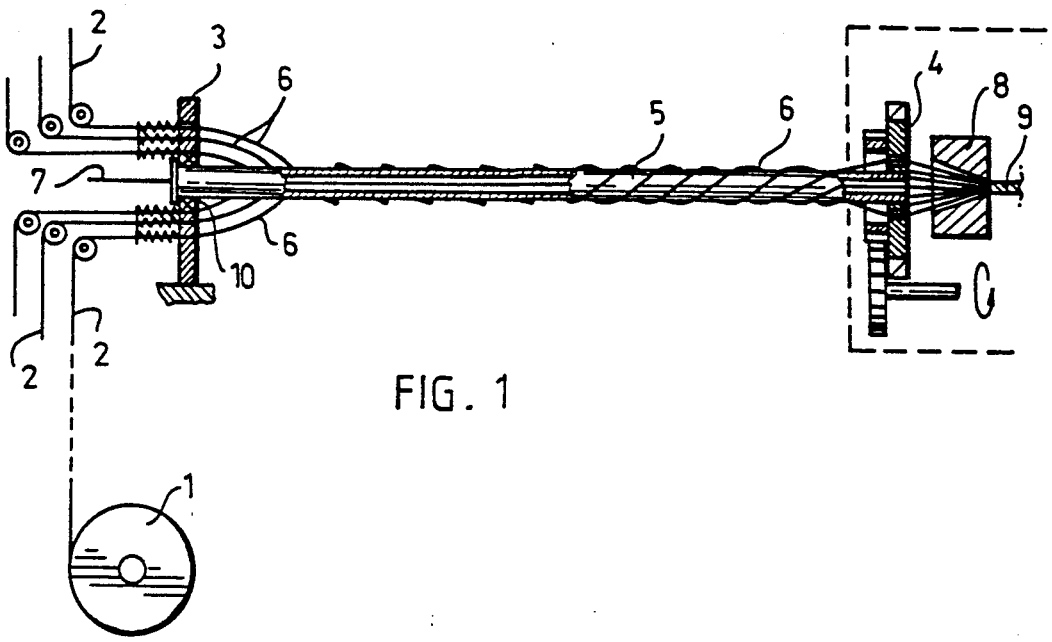
FIG. 1 is a diagrammatic side view of a first embodiment of the apparatus of the invention.
Figure 2:
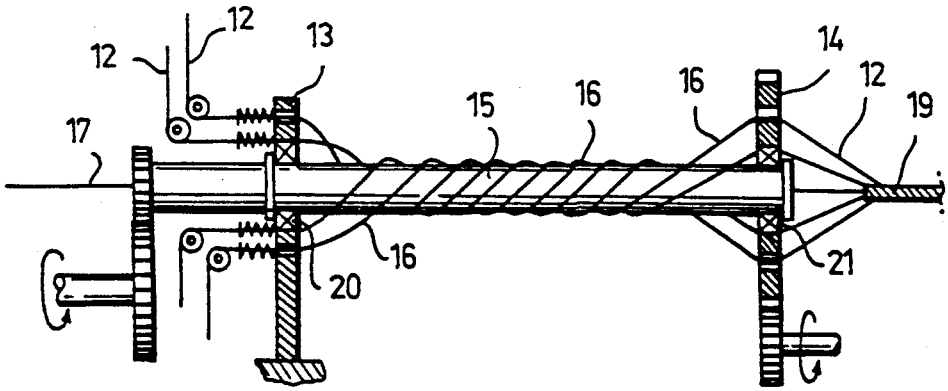
FIG. 2 is a diagrammatic side view of a second embodiment of the apparatus of the invention.

FIGS. 1 and 2 disclose two preferred embodiments of the apparatus of the invention. The embodiments of the figures include a stationary distributor means 3, 13 disposed at the upstream end for conductors 2, 12 to be drawn from pay-off reels 1 and to be twisted by means of the apparatus, a twisting means 4, 14 disposed at the downstream end, and a medially disposed central tube 5, 15 recurrently twistable about its longitudinal axis in opposite directions and peripheral tubes 6, 16 recurrently twistable in opposite directions and peripherally surrounding the central tube 5, 15, said central tube and peripheral tubes being disposed between the distributor means and twisting means. The central tube 5, 15 and peripheral tubes 6, 16 are pressed against each other at least during the twisting step of the conductors, and the conductors 2, 12 have been arranged to pass through the central tube 5, 15 and peripheral tubes 6, 16. The term conductor in this connection denotes filaments, conductor elements, bundles of conductors, quads, optical fibres and other corresponding elements.

When a reverse-twisted product is manufactured with the apparatus of FIGS. 1 and 2, the conductors 2, 12 to be twisted and a possible core member 7, 17 are drawn through the distributor means 3, 13 into the peripheral tubes 6, 16 and central tube 5, 15, respectively, and further via the twisting means 4, 14 out for instance into a nozzle 8 disposed downstream of the twisting means in the running direction of the conductors, having a tapering opening wherein the twisted conductors and the core member are pressed tightly against one another, forming a reverse-twisted product 9, 19. The nozzle 8 is not an indispensable detail. The product 9, 19 may, if necessary, be bound to prevent untwisting. Any conventional spinning device or other corresponding apparatus may be used for the binding.

The distributor means and twisting means may be for instance apertured disks, each having a central bore for the central tube 5, 15 and the core member 7, 17 to be drawn through the central tube, and a plurality of bores peripherally spaced at regular intervals and radially distanced from the central bore, for the peripheral tubes 6, 16 and for the conductors 2, 12 to be drawn through the peripheral tubes and to be twisted. The stationary distributor means 3, 13 at the upstream end for the conductors has been fixedly secured to the support structure of the reverse stranding apparatus, and the twisting means 4, 14 at the downstream end has been journalled to the support structure of the reverse stranding apparatus. The twisting means 4, 14 has been furnished with a rotating drive of its own, advantageously with a chain gear, gear transmission, or cogged belt driven electric motor whose rotating speed regulation and reversing automatism may be accomplished in a relatively simple way.

The peripheral tubes 6, 16 may be formed of thin tubes made from a bend-elastic material, said tubes being secured to bores in both the distributor means 3, 13 and the twisting means 4, 14 so that the tubes form a tube sheath around the central tube 5, 15. The peripheral tubes may be manufactured e.g. from polyamide or polytetrafluoroethylene.

During the twisting step of the conductors 2, 12, the peripheral tubes 6, 16 are twisted around the external surface of the central tube 5, 15 as a result of the rotating motion of the twisting means 4, 14. To compensate the increasing tensile stress produced by the twisting of the peripheral tubes, the ends of the peripheral tubes have been secured to at least the bores of the distributor means 3, 13 in an axially resilient manner. Furthermore, it is advantageous to bind the peripheral tubes elastically with one another, which eliminates the drawbacks produced by the centrifugal force. The structural details pertaining to the peripheral tubes have been described e.g. in U.S. Pat. No. 4,974,408.

In the embodiment of FIG. 1, the upstream end of the central tube 5 has been fitted in the central bore of the distributor means 3 as a part rotatable relative to the distributor means and furnished with a journalling 10 withstanding axial loads, whereas the downstream end has been rigidly secured to the central bore of the twisting means 4. In this embodiment, the rotating movements of the central tube 5 and the twisting movements of the peripheral tubes 6 are generated by the twisting means 4.

In the embodiment of FIG. 2, the central tube 15 has been rotatably fitted both in the stationary distributor means 13 and in the rotatable twisting means 14 thus journalled as a freely rotating part relative thereto. The journalling has been carried out by means of bearings 20 and 21. In this embodiment, both the central tube and the peripheral tube have their own rotating machinery to cause the rotating movements of the central tube and peripheral tubes.

The central tube may be manufactured from e.g. steel, but it should be noted that steel is not the only possible material, since the central tube may also be a torsion-elastic tube manufactured from a plastic material.

The structure and operation of the central tubes have been described for instance in U.S. Pat. No. 4,974,408. This patent also discloses technology relating to reverse stranding apparatus. Reference is made to this patent as background art in this connection.

Figure 3:
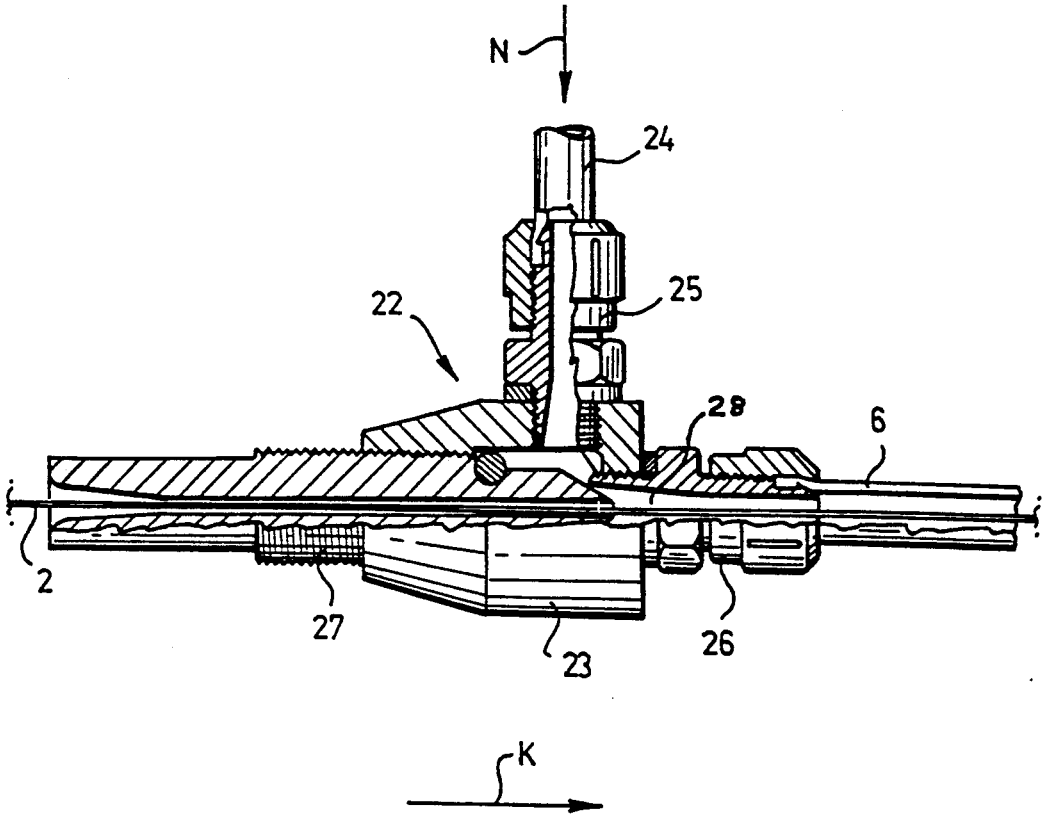
FIG. 3 is a diagrammatic side view of a detail of the apparatus of FIGS. 1 and 2.

FIG. 3 shows an essential detail of the apparatus of the invention on an enlarged scale. The detail of FIG. 3 may be located for instance at the upstream ends of the peripheral tubes of the apparatus of FIG. 1 or 2. In FIG. 3, this detail has been shown with reference to FIG. 1. In other words, the construction has been connected to the peripheral tubes 6 of the apparatus of FIG. 1, but it can also be used equally as well with the apparatus of FIG. 2.

In accordance with the invention, a pressurized fluid is fed into the peripheral tubes 6, 16 during the drawing of the conductors 2, 12. The purpose of the feeding of the pressurized fluid is to produce oscillation in the conductor passing through the peripheral tube, whereby the conductor will remain substantially detached from the inner surface of the peripheral tube as it passes through the peripheral tube. This may be realized by means of the structural detail of FIG. 3. Because of the invention, the friction between the peripheral tubes and the conductors is substantially diminished, since the conductor is detached from the walls of the peripheral tube during most of the part of its passage. The expression substantially detached from the inner surface of the, peripheral tube must be understood on this basis, because, the conductor will only momentarily touch the inner surface of the tube at some points of the tube as it passes through the tube. In connection with optical fibers, one achieves in winding an excess length of conductor in the groove of the core member of the cable.

As is apparent from FIG. 3, means 22 for feeding a pressurized fluid into the peripheral tubes 6 have been provided at the upstream ends of the peripheral tubes. The means 22 comprise a core member 23 and a feed tube 24 as well as clamping parts 25, 26 wherein the feed tube 24 has been secured to the core member and the core member to the peripheral tube 6 respectively. By reference numeral 27 a directing point has been denoted by means of which the conductor 2 is led into the core member wherefrom the conductor proceeds into the peripheral tube as shown in FIG. 3. With the directing point the flow is regulated to be the same in the different nozzles. The direction of feed of the pressurized fluid has been shown in FIG. 3 by arrow N and the direction of movement of the conductor 2 by arrow K respectively.

When a reverse-twisted product is prepared with the apparatus of FIG. 1 or 2, in accordance with the invention a pressurized fluid is fed into the peripheral tubes with the arrangement of FIG. 3 during the drawing of the conductors, whereby the oscillation created in the conductor diminishes the friction between the tube wall and the conductor, as the conductor will remain substantially detached from the tube wall.

As can be seen from FIG. 3, the pressure fluid is fed into an expansion chamber 28 formed within the core member. The expansion chamber 28 has been formed as a space which is advantageous in view of the flow. The pressurized fluid is advantageously fed into the expansion chamber so that a rotating motion about the longitudinal axis of the peripheral tube is imparted to the pressurized fluid, whereby the pressurized fluid flows into the peripheral tube in a substantially tangential direction.

Any suitable fluid, such as compressed air, may be used as the pressurized fluid. However, it is to be noted that the friction may be diminished also by cooling the peripheral tubes. Then different liquefied gases may be used as a pressurized fluid, and said liquefied gases are allowed to vaporize in the expansion chamber, in which event the pressurized fluid cools for instance an optical fibre. This fact may have significance e.g. in a tandem line.

By changing the flow volume of the pressurized fluid, one can eliminate the increase in friction produced by the twisting of the peripheral tubes, that is, the traction force in the conductors remains uniform even with large torsion angles of the torsion-elastic peripheral tubes. With a sufficient flow volume, for instance optical fibres can be made to move in the peripheral tube in line without using a traction apparatus. Changing the flow volume of the pressurized fluid may be realized for instance so that the pressurized fluid is fed into the peripheral tubes as a continuous flow volume the magnitude of which increases as the torsion angle of the peripheral tubes increases. Another possibility is for instance that the pressurized fluid is fed into the peripheral tubes as a pulsating flow volume the pulsating frequency of which increases as the torsion angle of the peripheral tubes increases.

In connection with optical cables, a grooved core member is used into who the optical fibres are lead. U.S. Pat. No. 4,754,049 is an example of such technology. The core member is guided so as to pass through the central tube and the fibres are twisted about the core member by means of the peripheral tubes. In the situation of FIG. 2, it could for example be contemplated that the core member is denoted with reference numeral 17. The fibres are conveyed into grooves in the surface of the core member past the twisting means, by means of tubes extending up to the grooves. An essential thing in connection with optical fibres is that during the run of the fibres a pressurized fluid is fed through the peripheral tube upstream ends into the peripheral tubes to produce oscillation in the fibre passing through each peripheral tube. Then the advancing speed of the fibre in the peripheral tube will rise higher than the transport speed of the core member, and a length of fibre greater than the length of the groove is fed into each groove of the core member. In this connection, it is to be noted that the expression a length of fibre greater than the length of the groove means that one achieves in depositing more fibre in the groove than is called for by the length or form—for instance sz or helical form—of the groove. On account of said excess length, the tensions in the fibre do not essentially change during changes in the load or operating ambient temperature, which eliminates the problems produced by an increase in the tension of the fibres. The advancing speed of the fibres in the peripheral tubes may be regulated for instance by regulating the flow rate of the pressurized fluid in the peripheral tubes.

The embodiments set forth above are in no way intended to restrict the invention, but the invention may be modified within the scope of the claims. Thus it is obvious that the apparatus of the invention or the details thereof need not necessarily be specifically as shown in the figures. For instance the expansion chamber, core member, clamping parts etc. may be of different shape in accordance with the respective circumstances.

I claim:

1. In a reverse twisting apparatus having an inlet end and outlet end and for forming a twisted cable product from a plurality of elongated conductor elements to be drawn through said apparatus from the inlet end to the outlet end thereof, said apparatus including a stationary distributor means located at the inlet end of the apparatus, a rotatable twisting means located at the outlet end of the apparatus, a medially disposed central tube being twistable recurrently about its longitudinal axis in both directions and peripheral tubes connected between said distributor and twisting means peripherally surrounding the central tube, said peripheral tubes being twistable recurrently in both directions by the rotation of said twisting means, the central tube and peripheral tubes each having inner and external surfaces and being located between the distributor means and the twisting means with the peripheral tubes being twisted around the external surface of the central tube as a result of the rotation of the twisting means, the elements to be twisted being adapted to be drawn through at least said peripheral tubes, the improvement comprising means for feeding a pressurized fluid into the inlet ends of each of the peripheral tubes to produce an oscillation in the conductor elements drawn through each said peripheral tube, whereby the conductor elements remain substantially away from the inner surfaces of the peripheral tubes as they are drawn through the tubes.

2. The apparatus of claim 1, wherein the means for feeding a pressurized fluid into the peripheral tubes directs the pressurized fluid tangentially onto the inner surface of each peripheral tube.

3. In a method for reverse twisting to form a cable product from a plurality of elongated conductor elements including drawing the elements from a distributor means adjacent upstream ends of and through a plurality of peripheral tubes circumferentially surrounding a central tube and into a nozzle device adjacent downstream ends thereof, said peripheral tubes having inner surfaces and being twistable around the central tube recurrently in opposite directions, the improvement comprising feeding a pressurized fluid into the upstream ends of and into each of the peripheral tubes during the drawing of the conductors through the tubes to produce an oscillation in the conductor elements as they are drawn through each peripheral tube, whereby the conductor elements remain substantially away from the inner surfaces of the peripheral tubes as they are drawn through them.

4. In a method for the twisting of elongated optical fiber elements, including drawing the elements from a distributor means adjacent upstream ends of and through a plurality of peripheral tubes circumferentially surrounding a central tube and into a nozzle device adjacent downstream ends thereof, drawing a grooved core member through the central tube and guiding the fiber elements by means of the peripheral tubes into the grooves in the core member, said peripheral tubes being twistable around the central tube, the improvement comprising feeding a pressurized fluid into the upstream ends of and into each of the peripheral tubes during the drawing of the fiber elements through the tubes to produce an oscillation in the fiber elements as they pass through each peripheral tube to thereby advance the speed of the fibers in the peripheral tubes above the drawing speed of the core members so that a length of fiber greater than the length of the groove will be fed into each groove in the core member.

5. The method of claim 3 or 4, wherein the advancing speed of the elements is regulated by adjusting the flow rate of the pressurized fluid in the peripheral tubes.

6. The method of claim 3 or 4, wherein the pressurized fluid is fed tangentially into the peripheral tubes.

7. The method of claim 3 or 4, wherein the pressurized fluid is fed into the peripheral tubes at a continuous flow volume the magnitude of which increases as the torsion angle of the twisted peripheral tubes increases.

8. The method of claim 3 or 4, wherein the pressurized fluid is fed into the peripheral tubes at a pulsating flow volume the pulsating frequency of which increases as the torsion angle of the twisted peripheral tubes increases.

9. The method of claim 3 or 4, wherein the pressurized fluid is air.

* * * * *